US005144989A

United States Patent [19]

Mika et al.

[11] Patent Number: 5,144,989

[45] Date of Patent: Sep. 8, 1992

[54] PORTABLE CABLE TIE DISPENSER

[75] Inventors: Anton L. Mika, Downers Grove; Robert F. Levin, Braceville, both of Ill.

[73] Assignee: Panduit Corp., Tinley Park, Ill.

[21] Appl. No.: 697,850

[22] Filed: May 9, 1991

[51] Int. Cl.[5] ..... B21F 9/02

[52] U.S. Cl. ..... 140/93.2; 140/93 A; 140/123.6

[58] Field of Search ..... 140/93 A, 93.2, 123.6

[56] References Cited

U.S. PATENT DOCUMENTS 4,359,070 11/1982 Hidassy et al. ..... 140/93.2
4,495,972 1/1985 Walker ..... 140/93 A
4,498,506 2/1985 Moody et al. ..... 140/93.2
4,640,320 2/1987 Avison et al. ..... 140/93.2
4,790,225 12/1988 Moody et al. ..... 140/93.2

*Primary Examiner*—David Jones
*Attorney, Agent, or Firm*—Charles R. Wentzel; Mark D. Hilliard

[57] ABSTRACT

A portable cable tie dispenser for providing individual cable ties from a ribbon of cable ties including a grooved cylinder for positioning the cable ties for severance from the ribbon and sequential transfer to a cable tie application tool, the grooved cylinder being driven by an electric motor disposed within the cylinder.

7 Claims, 7 Drawing Sheets

PORTABLE CABLE TIE DISPENSER

TECHNICAL FIELD

The present invention relates generally to dispensers for providing individual cable ties from a ribbon of cable ties to an automatic cable tie application tool and specifically relates to a portable dispenser.

BACKGROUND ART

U.S. Pat. No. 4,498,506 to Moody et al., which is assigned to our common assignee, Panduit Corp., discloses a dispenser that provides individual cable ties for transfer through a pneumatic transfer tube to an automatic cable tie installation tool for installation of the cable tie around a bundle of wires. The dispenser of Moody et al. is designed to dispense large numbers of cable ties and is too large and heavy to allow an operator to easily carry the dispenser. Thus, there is room for improvement in the art.

SUMMARY OF THE INVENTION

The object of the present invention is to provide an improved dispenser that is portable allowing an operator to carry the dispenser while applying cable ties with an automatic cable tie installation tool.

It is an additional object of the present invention to provide an improved dispenser that facilitates accurate and simple adjustment of a cable tie receiver of the dispenser.

It is a further object of the present invention to provide an improved dispenser having an improved means of transferring cable ties from the dispenser to a cable tie application tool.

In general a portable cable tie dispenser for providing individual cable ties from a ribbon of cable ties for provision to a cable tie application tool includes separating means for separating individual cable ties from the ribbon of cable ties; transfer means for providing the individual cable ties from the dispenser to the cable tie installation tool; a hollow cylindrical cable tie receiver having a plurality of longitudinal splines that define cable tie positioning grooves disposed parallel to the axis of the cable tie receiver; receiver mounting means for rotatably mounting the cable tie receiver; and motor means mounted within the hollow cable tie receiver and operatively connected to the cable tie receiver for incrementally rotating the cable tie receiver.

DESCRIPTION OF THE PREFERRED EMBODIMENT

A portable cable tie dispenser embodying the concept of the present invention is designated generally by the numeral 20 in the accompanying drawings.

Dispenser 20 is designed to dispense individual cable ties from a ribbon of cable ties to an automatic cable tie installation tool. The ribbon of cable ties and the automatic tool are described in detail in U.S. Pat. No. 4,498,506, assigned to our common assignee, Panduit Corp., which is incorporated herein by reference.

Figure 1:
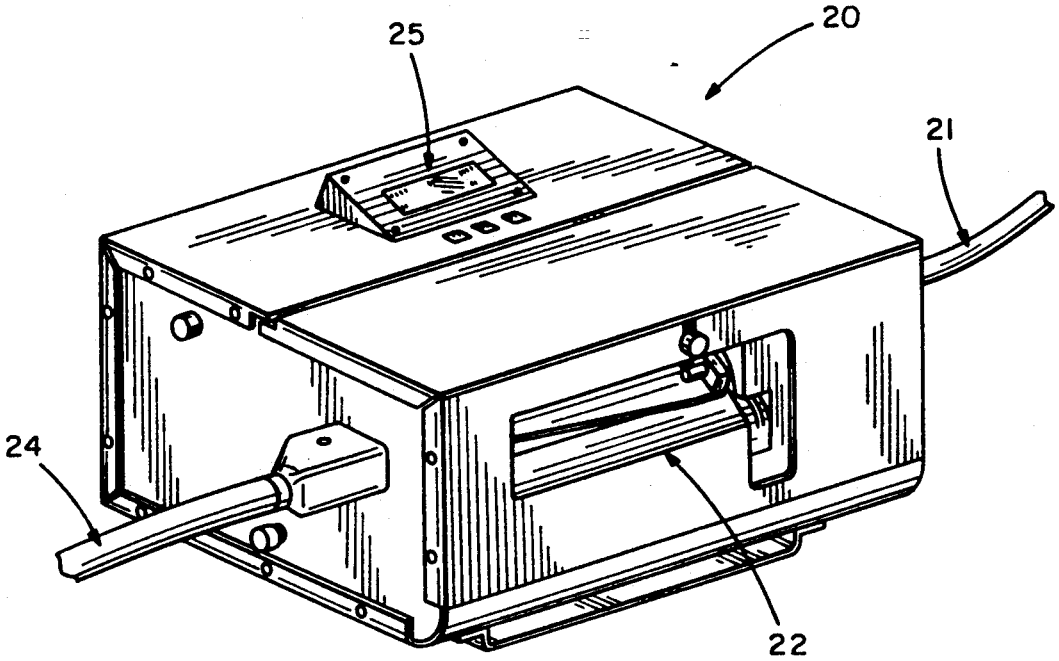
FIG. 1 is an isometric view of a portable cable tie dispenser embodying the concept of the present invention.

As seen in FIG. 1, dispenser 20 is designed as a portable unit weighing approximately 11.5 pounds (5.2 kg). Dispenser 20 includes a pneumatic air supply hose 21, a cable tie ribbon entry slot 22, a flexible conveyor hose 24 for connection to the cable tie installation tool (not shown) and a tool information display 25 for informing the operator of the condition of dispenser 20. Dispenser 20 is designed to be easily portable having a shoulder strap (not shown) secured on either side of entry slot 22 with the operator thus inserting a section of cable tie ribbon downward into the entry slot, allowing the distal end of the ribbon to drape over the side of the dispenser 20.

Figure 2:
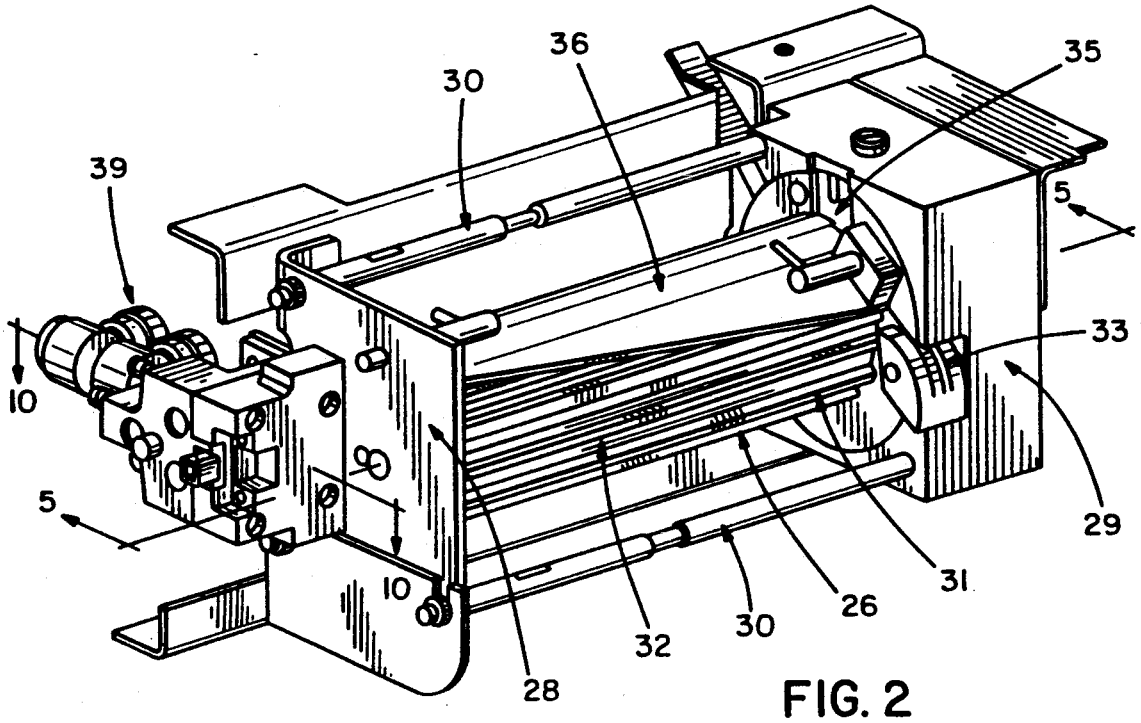
FIG. 2 is an isometric view of the dispenser of FIG. 1 with a cover of the dispenser removed showing an internal mechanism of the dispenser.

With reference to FIG. 2, dispenser 20 includes a hollow, cylindrical cable tie receiver 26 rotatably mounted between left and right receiver mounting frames 28 and 29 which are structurally connected by tie rods 30.

Figure 6:
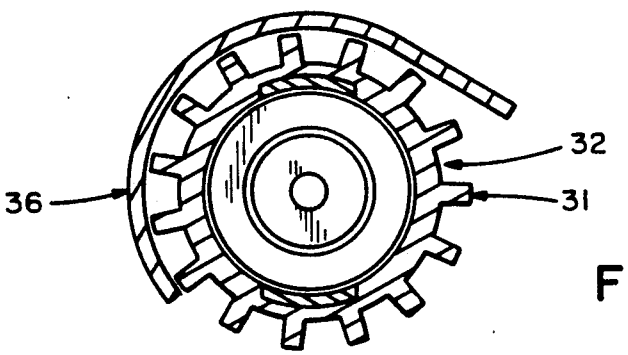
FIG. 6 is a sectional view of the cable tie receiver of the dispenser of FIG. 1 taken along line 6—6 of FIG. 5.

Cable tie receiver 26 includes a plurality of spaced apart longitudinally extending splines 31 disposed around the circumference of receiver 26, defining between adjacent splines 31 fifteen cable tie receiving grooves 32. See FIG. 6. A cable tie ribbon guide 33 mounted in a guide collar 34 (See FIG. 3) accepts and guides the strip portion of the cable tie ribbon. A cable tie severance blade 35 is disposed to sever the leading cable tie from the strip of the ribbon as it is rotated past blade 35 as described in detail in the above patent. A receiver cover 36 encloses underlying grooves 32 containing severed individual cable ties. When the leading cable tie containing groove of the cable tie receiver is rotated into alignment with an exit port 38 (see FIG. 9), which in FIG. 2 is located at the back of the dispenser, high pressure air is injected from the right into the groove by pneumatic circuitry (not shown) and the tie is ejected from the groove and into transfer assembly 39.

Figure 3:
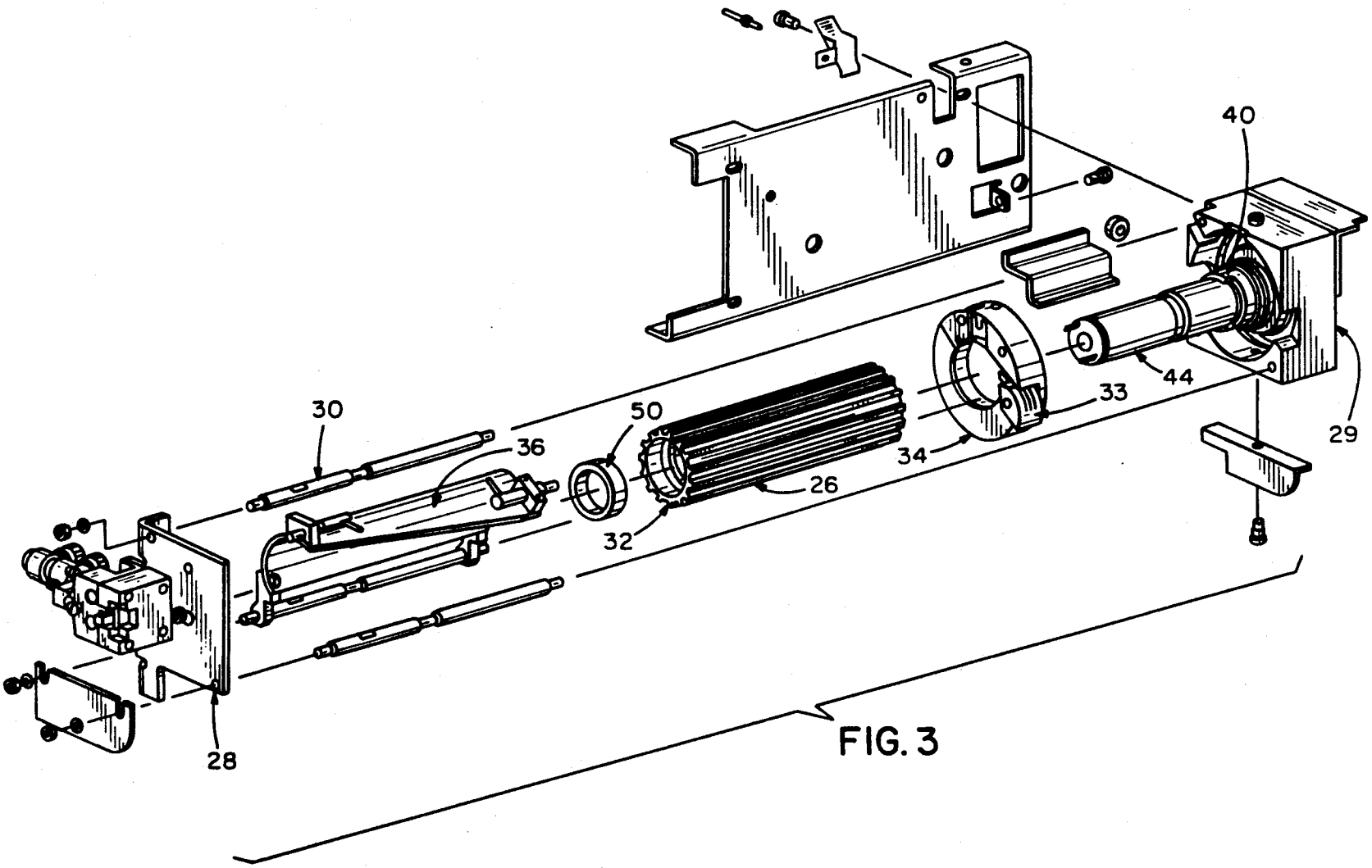
FIG. 3 is an exploded assembly view of a receiver assembly of the dispenser of FIG. 1.
Figure 4:
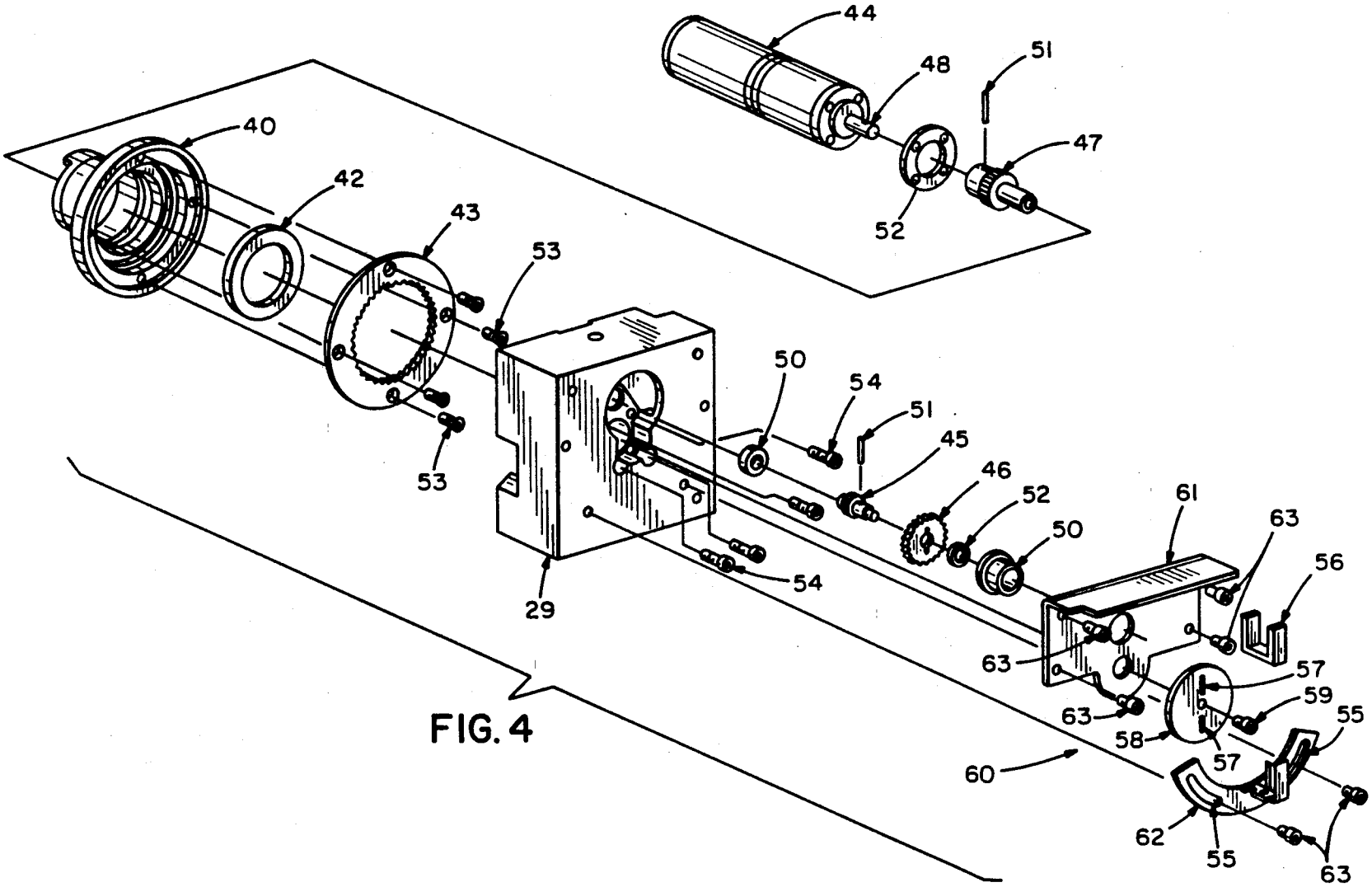
FIG. 4 is an exploded assembly view of a receiver drive assembly of the dispenser of FIG. 1.
Figure 7:
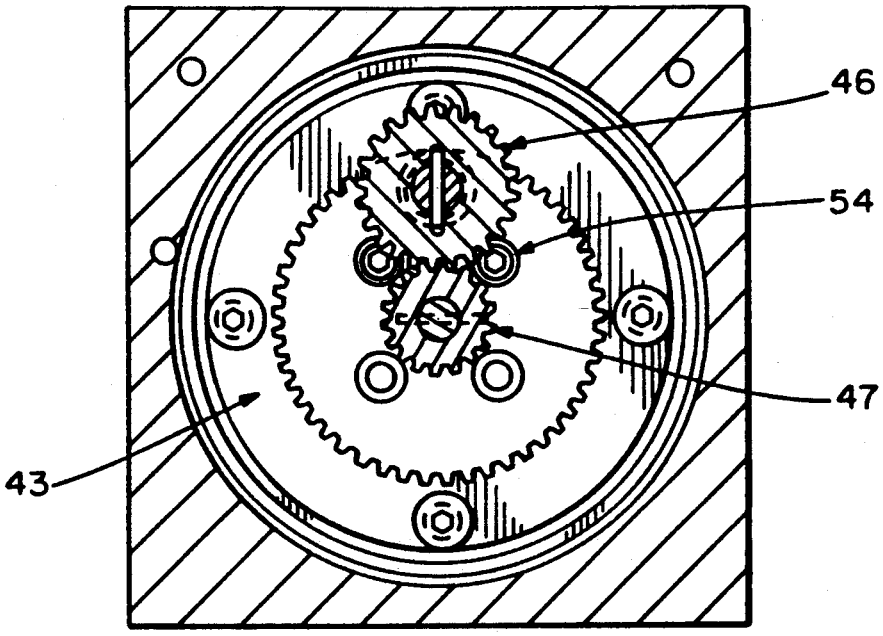
FIG. 7 is a sectional view taken along line 7—7 of FIG. 5.

As best seen in FIGS. 3, 4 and 7, receiver 26 is mounted to a drum drive collar 40 which is mounted for rotation relative to right mounting frame 29 by bearing 42. A ring gear 43 is secured to drum drive collar 40 to drive it and receiver 26 directly with the rotation of an electric motor 44 in the following manner: ring gear 43 meshes with an input pinion gear 45 which carries a transfer gear 46 which meshes with an output pinion gear 47 which is secured to shaft 48 of electric motor 44. Appropriate bushings 50, pins 51, spacers 52, and fasteners 53 are provided in a manner known in the art to complete assembly.

Electric motor 44 is mounted to right mounting frame 29 by fasteners 54 and is disposed to project into the interior of hollow cable tie receiver 26 which provides for a more compact and portable dispenser 20. In preferred form, the control circuitry and electric motor are powered by batteries eliminating the need for an electric power cord.

Figure 5:
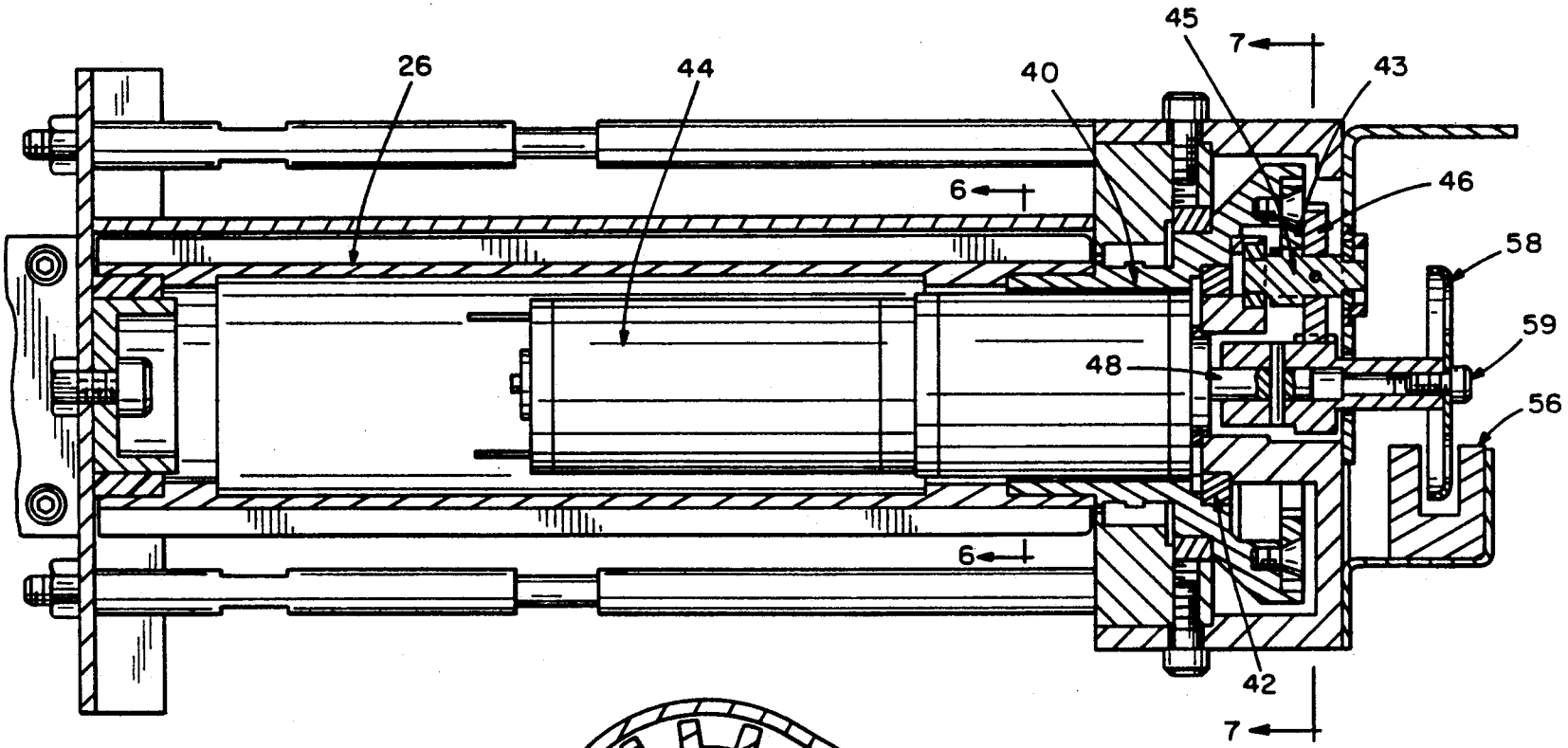
FIG. 5 is a sectional view taken along line 5—5 of FIG. 2.
Figure 8:
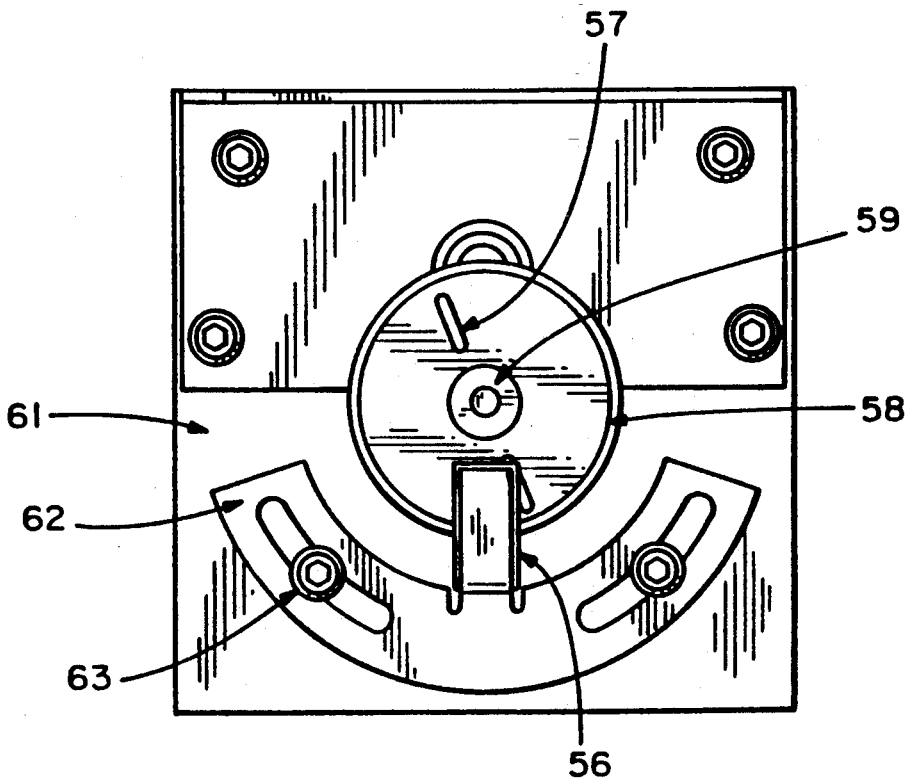
FIG. 8 is an end view of the receiver drive assembly of FIG. 4.

Accurate sequential alignment of grooves 32 of receiver 26 with exit port 38 is provided by the dispenser control circuitry that actuates electric motor 44 to rotate shaft 48 to effect 1/15 revolution of receiver. Accurate partial rotation of receiver is controlled by an optical control sensor 56, best seen in FIGS. 4, 5 and 8, which senses the position of either of two slots 57 positioned in a sensor disk 58, which is secured to output pinion 47 gear by a bolt 59 for direct rotation with shaft 48 of motor 44, and provides an output to the control circuitry to turn off motor 44 when either slot 57 is sensed.

Alignment of grooves 32 of receiver 26 is provided by an adjustable sensor mounting assembly 60 that includes a main mounting bracket 61, an adjustable mounting bracket 62 having adjustment slots 55 and a plurality of fasteners 63 to secure main mounting bracket 61 to right mounting frame 29 and to secure adjustable mounting bracket 62 to main bracket 61. Sensor 56 is immovably mounted to bracket 62 and thus is positioned by rotation of bracket 62. Initial relative positioning of grooves 32 with exit port 38 is preferably effected by loosening fasteners 63 securing adjustable mounting bracket 62 and repeatedly performing the steps of adjusting the position of bracket 62, actuating the control circuitry of dispenser 20, and checking the alignment of one of grooves 32 with exit port 38, until a groove 32 is accurately aligned with exit port 38. Then fasteners 63 are tightened to secure adjustable mounting bracket 62 in correct relative position.

Figure 9:
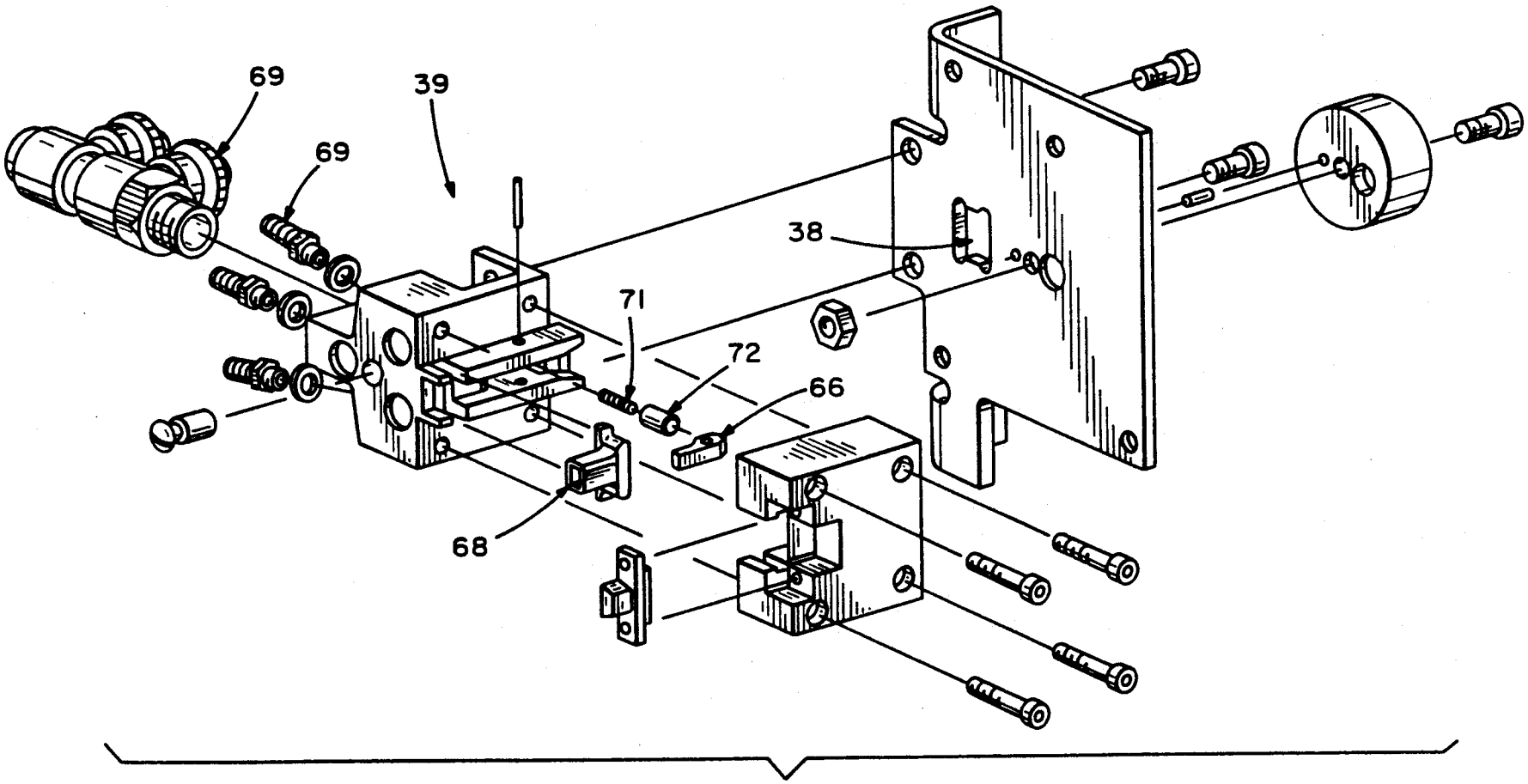
FIG. 9 is an exploded assembly view of a cable tie transfer assembly of the dispenser of FIG. 1.
Figure 10:
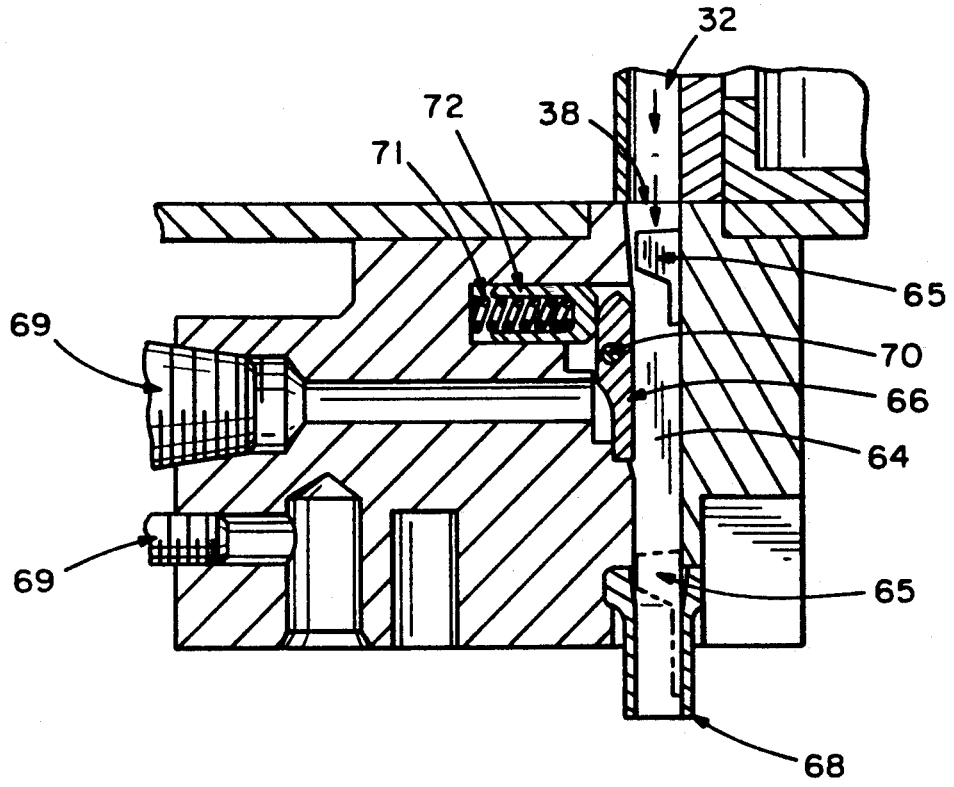
FIG. 10 is a sectional view taken along line 10—10 of FIG. 2 showing the open position of a gate of the transfer assembly of the dispenser of FIG. 1.
Figure 11:
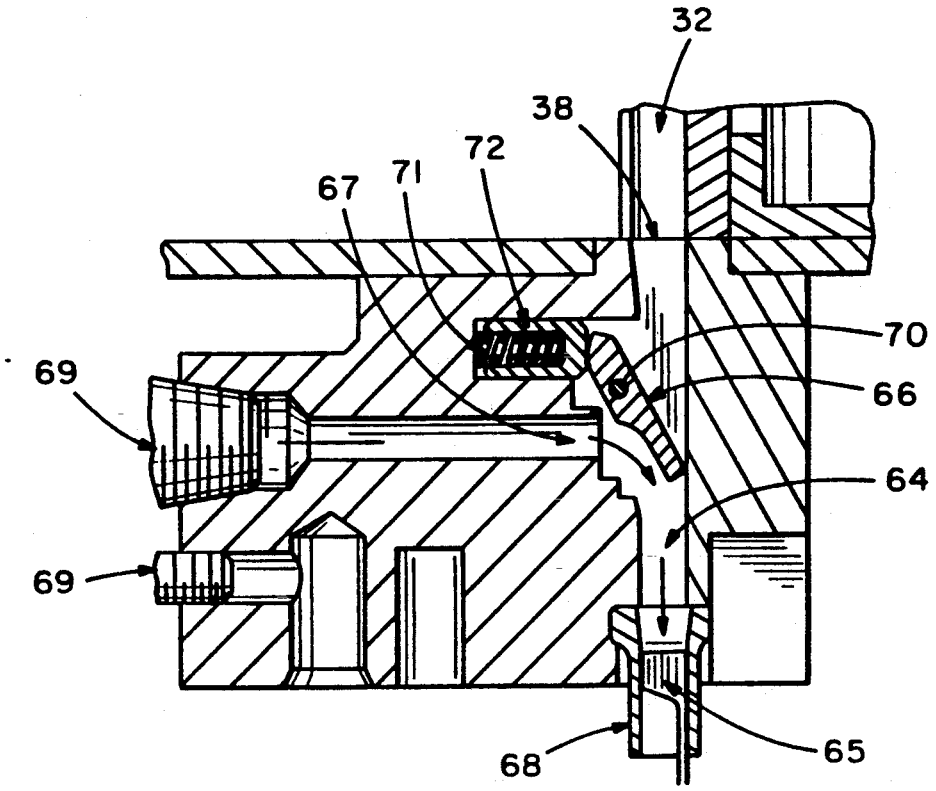
FIG. 11 is the sectional view of FIG. 10 showing the closed position of the gate.

Transfer assembly 39, as best seen in FIGS. 9–11, includes a cable tie positioning chamber 64 which accepts a cable tie 65 ejected by pressurized air from exit port 38, as illustrated by the arrows in FIG. 10, and positions it for subsequent conveyance through conveyance hose 24 to the cable tie installation tool, a pivotally mounted gate 66, pneumatic circuitry for the provision of pressurized air at an outlet 67 disposed adjacent the distal end of gate 66, and a hose nozzle 68 that mates with conveyance hose 24. Pneumatic circuitry includes known combinations of valves (not shown) and fittings 69 necessary to provide the pressurized air to outlet 67.

Gate 66 is pivotally mounted by pin 70 and resiliently biased by a spring 71 biasing a piston 72 against the rearward end of gate 66 towards an open position in communication with the aligned groove 32 of receiver 20 as seen in FIG. 10. An application of pressurized air at outlet 67, as illustrated by the arrows in FIG. 11, pivots gate 66 to a closed position preventing communication with groove 32 and concurrently ejecting cable tie 65 from chamber 64 and through conveyance hose 24, as seen in FIG. 11. Transfer assembly 39 reduces the possibility of a cable tie jamming in assembly and provides a simple and effective mechanism to transfer the cable tie 65 from dispenser 20.

We claim:

1. A portable cable tie dispenser for providing individual cable ties from a ribbon of cable ties for provision to a cable tie application tool, comprising:

a hollow cylindrical cable tie receiver having a plurality of longitudinal splines that define cable tie positioning grooves disposed parallel to an axis of the cable tie receiver for receiving the ribbon of cable ties;

receiver mounting means for rotatably mounting the cable tie receiver to the dispenser;

motor means mounted to the dispenser and contained within the hollow cable tie receiver and operatively connected to the cable tie receiver for incrementally rotating the cable tie receiver;

separating means mounted on the dispenser adjacent the cable tie receiver for separating individual cable ties from the ribbon of cable ties; and transfer means mounted to the dispenser for providing the individual cable ties separated from the ribbon by the separating means to the cable tie installation tool.

2. A dispenser as set forth in claim 1, wherein the motor means is an electric motor.

3. A dispenser as set forth in claim 2, wherein the electric motor directly drives the cable tie receiver through power transmission gears.

4. A dispenser as set forth in claim 3, wherein the motor is mounted to the receiver mounting means.

5. A dispenser as set forth in claim 1, including receiver position adjustment means for facilitating accurate and rapid adjustment of a circumferential position of the cable tie receiver.

6. A dispenser as set forth in claim 5, wherein the receiver position adjustment means includes a slotted sensor disk operatively connected to the cable tie receiver for rotation therewith, an optical sensor disposed to sense the position of a slot in the sensor disk and provide an output, mounting means for adjustably mounting the optical sensor to allow selective positioning of the optical sensor relative to the sensor disk, and control means responsive to the output of the optical sensor for controlling the rotation of the motor means.

7. A dispenser as set forth in claim 1, wherein the transfer means includes:

a cable tie positioning chamber;

a cable tie exit port adjacent to and aligned with the cable tie positioning chamber;

a source of pneumatic pressure for ejecting a severed cable tie from a groove of the cable tie receiver through the cable tie exit port into the cable tie positioning chamber;

a gate pivotally mounted between the cable tie exit port and the cable tie positioning chamber for movement between an open position in communication with the groove and a closed position preventing communication with the groove, with the gate being resiliently biased to an open position; and a gate closing means for providing a source of pneumatic pressure that pivots the gate closed and ejects the cable tie from the cable tie positioning chamber of the dispenser.

* * * * *